US008925252B2

(12) United States Patent
Meager et al.

(10) Patent No.: US 8,925,252 B2
(45) Date of Patent: Jan. 6, 2015

(54) QUICK DEPLOY FIRE SHELTER

(75) Inventors: Benjamin Meager, Bozeman, MT (US); Andrew Powell, San Juan Capistrano, CA (US)

(73) Assignee: Paha Designs, LLC, Denver, CO (US)

( * ) Notice: Subject to any disclaimer, the term of this patent is extended or adjusted under 35 U.S.C. 154(b) by 0 days.

(21) Appl. No.: 13/294,629

(22) Filed: Nov. 11, 2011

(65) Prior Publication Data

US 2012/0144756 A1 Jun. 14, 2012

Related U.S. Application Data

(60) Provisional application No. 61/412,727, filed on Nov. 11, 2010, provisional application No. 61/484,503, filed on May 10, 2011.

(51) Int. Cl.

| | |
|---|---|
| ***E04G 11/04*** | (2006.01) |
| ***E04H 15/20*** | (2006.01) |
| ***E04H 9/16*** | (2006.01) |
| ***A62C 2/10*** | (2006.01) |
| *A62C 8/06* | (2006.01) |

(52) U.S. Cl.

CPC .. *E04H 9/16* (2013.01); *A62C 2/10* (2013.01); *A62C 8/06* (2013.01); *E04H 2015/201* (2013.01)

USPC ..... 52/2.11; 52/2.17; 52/2.18

(58) Field of Classification Search

CPC ..... E04H 15/20; E04H 15/22; A62C 2/10

USPC ..... 52/1, 2.11, 2.13, 2.17, 2.18, 2.23, 2.25

See application file for complete search history.

(56) References Cited

U.S. PATENT DOCUMENTS

| | | | | |
|---|---|---|---|---|
| 3,478,472 | A * | 11/1969 | Kwake | 52/1 |
| 3,575,229 | A | 4/1971 | Alley | |
| 3,635,290 | A | 1/1972 | Schneider | |
| 3,682,225 | A * | 8/1972 | Redden | 160/98 |
| 3,687,185 | A | 8/1972 | Singer | |
| 3,756,137 | A | 9/1973 | Scharres | |
| 3,766,958 | A | 10/1973 | Mitchell | |
| 3,801,093 | A * | 4/1974 | Jones, III | 472/94 |
| 3,810,262 | A * | 5/1974 | Strand | 52/2.14 |
| 3,911,913 | A | 10/1975 | June | |
| 4,004,380 | A | 1/1977 | Kwake | |
| 4,077,474 | A | 3/1978 | Hattori | |
| 4,332,049 | A | 6/1982 | Fisher | |
| 4,449,341 | A | 5/1984 | Taglianetti et al. | |
| 4,509,559 | A | 4/1985 | Cheetham et al. | |

(Continued)

OTHER PUBLICATIONS

International Search Report for PCT/US11/60337, mailed on Mar. 28, 2012 3 pages.

(Continued)

*Primary Examiner* — Jeanette E Chapman
*Assistant Examiner* — James Buckle, Jr.
(74) *Attorney, Agent, or Firm* — Sheridan Ross P.C.

(57) ABSTRACT

A rapidly-deployable fire shelter is described herein. Specifically, the fire shelter is equipped with one or more actuators that enable the fire shelter to be rapidly deployed thereby providing a quick and effective mechanism for protecting items or people from fire, smoke, and the other fire-related hazards. The fire shelter may include a protective barrier that is extended upon activation of the one or more actuators.

18 Claims, 16 Drawing Sheets

(56) References Cited

U.S. PATENT DOCUMENTS

| | | | | |
|---|---|---|---|---|
| 4,766,918 | A | 8/1988 | Odekirk | |
| 4,819,389 | A | 4/1989 | Kihn | |
| 4,876,829 | A | 10/1989 | Mattick | |
| 4,899,962 | A | 2/1990 | Mueller | |
| 4,943,252 | A | 7/1990 | Manix | |
| 5,007,212 | A | 4/1991 | Fritts et al. | |
| 5,083,617 | A | 1/1992 | Pierce, Jr. | |
| 5,123,434 | A | 6/1992 | Fetterly | |
| 5,247,768 | A * | 9/1993 | Russo | 52/2.13 |
| 5,450,890 | A | 9/1995 | Pinkalla et al. | |
| 5,471,797 | A | 12/1995 | Murphy | |
| 5,479,743 | A | 1/1996 | Queen et al. | |
| 5,487,400 | A | 1/1996 | Dawkins | |
| 5,537,784 | A | 7/1996 | Baldwin | |
| 5,542,463 | A | 8/1996 | Pinkalla et al. | |
| 5,566,736 | A | 10/1996 | Crider et al. | |
| 5,570,544 | A | 11/1996 | Hale et al. | |
| 5,579,609 | A | 12/1996 | Sallee | |
| 5,607,758 | A | 3/1997 | Schwartz | |
| 5,630,296 | A * | 5/1997 | Kendall, Jr. | 52/2.11 |
| 5,752,557 | A | 5/1998 | Crider et al. | |
| 5,761,852 | A | 6/1998 | Liu | |
| 5,809,699 | A | 9/1998 | Joly | |
| 5,811,359 | A | 9/1998 | Romanowski | |
| 5,860,251 | A | 1/1999 | Gleich | |
| 5,921,388 | A | 7/1999 | Petrilli et al. | |
| 5,987,822 | A | 11/1999 | McNiff et al. | |
| 6,011,504 | A | 1/2000 | Tan | |
| 6,192,633 | B1 | 2/2001 | Hilbert | |
| 6,202,732 | B1 | 3/2001 | Chen | |
| 6,213,429 | B1 | 4/2001 | Chu | |
| 6,224,018 | B1 | 5/2001 | Hinestroza | |
| 6,260,306 | B1 | 7/2001 | Swetish et al. | |
| 6,263,617 | B1 | 7/2001 | Turcot et al. | |
| 6,282,843 | B1 | 9/2001 | Shibaike et al. | |
| 6,401,487 | B1 | 6/2002 | Kotliar | |
| 6,658,801 | B2 | 12/2003 | Kilduff et al. | |
| 6,722,084 | B2 | 4/2004 | Berman | |
| 6,881,506 | B2 | 4/2005 | Anderson et al. | |
| 6,918,447 | B2 | 7/2005 | Robinson, Jr. | |
| 6,929,016 | B2 | 8/2005 | Lee | |
| 6,962,364 | B2 | 11/2005 | Ju et al. | |
| 7,070,201 | B2 | 7/2006 | Song et al. | |
| 7,128,207 | B2 | 10/2006 | Anderson et al. | |
| 7,523,778 | B2 | 4/2009 | Roberts et al. | |
| 7,608,550 | B2 | 10/2009 | Bennett | |
| 7,802,629 | B2 | 9/2010 | Freitag et al. | |
| 7,810,576 | B2 | 10/2010 | Reick | |
| 7,841,269 | B1 | 11/2010 | Jacobs | |
| 7,866,101 | B2 | 1/2011 | Boggs, Jr. | |
| 8,079,182 | B1 * | 12/2011 | Higgins | 52/2.11 |
| 2002/0023390 | A1 | 2/2002 | Nagle | |
| 2002/0046522 | A1 | 4/2002 | Kilduff et al. | |
| 2002/0139407 | A1 | 10/2002 | Spiteri | |
| 2003/0106155 | A1 | 6/2003 | Arai | |
| 2003/0218324 | A1 | 11/2003 | Ju et al. | |
| 2004/0108693 | A1 | 6/2004 | Foster et al. | |
| 2005/0184494 | A1 | 8/2005 | Sakata | |
| 2006/0277830 | A1 | 12/2006 | Boggs, Jr. | |
| 2007/0113486 | A1 | 5/2007 | Howland | |
| 2007/0218825 | A1 | 9/2007 | Howery | |
| 2008/0017229 | A1 * | 1/2008 | Brewin et al. | 135/87 |
| 2008/0067792 | A1 | 3/2008 | Breed | |
| 2008/0243342 | A1 | 10/2008 | Breed | |
| 2009/0139668 | A1 | 6/2009 | Naylor | |
| 2009/0249700 | A1 * | 10/2009 | Peterson et al. | 52/2.17 |
| 2009/0266498 | A1 | 10/2009 | Cooper et al. | |
| 2009/0288784 | A1 | 11/2009 | Graneto, III | |
| 2009/0288785 | A1 | 11/2009 | Graneto, III | |
| 2010/0057305 | A1 | 3/2010 | Breed | |
| 2010/0212845 | A1 | 8/2010 | Graneto, III et al. | |
| 2010/0294520 | A1 | 11/2010 | Aguirre | |
| 2011/0067891 | A1 | 3/2011 | Linares | |

OTHER PUBLICATIONS

Written Opinion for PCT/US11/60337, mailed on Mar. 28, 2012 6 pages.

International Preliminary Report on Patentability for International (PCT) Patent Application No. PCT/US2011/060337, mailed May 23, 2013 8 pages.

* cited by examiner

QUICK DEPLOY FIRE SHELTER

FIELD OF THE DISCLOSURE

The present disclosure is generally directed toward fire shelters and barriers and specifically directed toward rapidly-deployable fire shelters and barriers.

BACKGROUND

A wildfire is any uncontrolled fire in combustible vegetation that occurs in the countryside or a wilderness area. Depending upon the location of the wildfire, a wildfire can be referred to by other names as brush fire, bushfire, forest fire, desert fire, grass fire, hill fire, squirrel fire, vegetation fire, veldfire, and wildland fire. Wildfires, like other fires, have the potential for causing a great amount of damage to both property and life. A wildfire differs from other fires by its extensive size, the speed at which it can spread out from its original source, its potential to change direction unexpectedly, and its ability to jump gaps such as roads, rivers and fire breaks. Wildfires are characterized in terms of the cause of ignition, their physical properties such as speed of propagation, the combustible material present, and the effect of weather on the fire. Needless to say, wildfires present many challenges that are not presented by structure fires and other types of fires.

While some wildfires burn in remote forested regions, they can cause extensive destruction of homes and other property located in the wildland-urban interface: a zone of transition between developed areas and undeveloped wilderness. Properties in these zones of transition are often viewed by insurance companies as uninsurable properties against fire damage.

In the United States, the National Forest Service is primarily responsible for deploying firefighters throughout the nation to combat wildfires. These firefighters often work several weeks straight with minimal time off, especially during the summer months when wildfires are most prevalent. Moreover, the dangers of wildfires encountered by firefighters are many. As noted above, wildfires are often fast moving and susceptible to sudden changes in direction. Unfortunately, tools currently available to firefighting personnel as well as residents in zones of transition are rudimentary at best.

Many currently available personal fire shelter systems use a fire retardant material on the interior and exterior of the fire shelter structure. While the fire retardant material is useful at combating effects of heat and flame, the fire retardant material increases the weight of the shelter system and is unnecessary on the inside of the shelter structure. Prior art fire shelter systems also use a floor, which does not allow the cooling effect of cleared ground. Further still, prior art designs of fire shelter systems have an entrance on top of the shelter, creating an air inlet for combustible air to enter the shelter. Indeed, current designs in personal fire shelters leave much to be desired.

Similarly, current designs for residential, vehicular, and structural fire shelters are cumbersome and difficult to deploy. As an example, some currently-available residential fire shelters require hours to deploy because they are designed to completely cover the residential structure. As another example, vehicular fire shelters require manual deployment (e.g., unfolding and securing to the vehicle) and are therefore not usually capable of rapid deployment, especially when personnel is not right next to the vehicle.

SUMMARY

It is, therefore, one aspect of the present disclosure to provide a fire shelter that is capable of rapid deployment. It is another aspect of the present disclosure to provide a rapidly-deployable fire shelter for protecting persons as well as structures, vehicles, and the like.

In some embodiments, a fire shelter is disclosed that includes a protective barrier that is initially in a non-deployed state (e.g., within a case, container, housing, etc.). The fire shelter may be equipped with one or more actuators that cause the protective barrier to transition into a deployed state within a matter of seconds.

In some embodiments, an actuator for the fire shelter may comprise a source of compressed gas. The compressed gas may be released from the actuator either manually, remotely, or automatically. Once the compressed gas is released, the compressed gas may be expelled into a protective barrier of the fire shelter thereby establishing a structure for the fire shelter. Depending upon the nature of the structure, the fire shelter can be used to protect people, vehicles, structures, and the like.

In some embodiments, a rapidly-deployable fire shelter is disclosed that is particularly well suited for personal use. The fire shelter may utilize the compressed gas and a tube frame to support and protect a firefighter who is inside the fire shelter. The ease and speed of deployment is greatly enhanced as compared to previously-available fire shelters. The tube frame may establish a protective cavity for the firefighter and when it is fully deployed, the cavity creates a safe environment for the firefighter. In some embodiments, with intense heat, the gas within the tube frame may expand. It may, therefore, be desirable to incorporate one or more release valves into the tube frame to automatically relieve the excessive pressure.

In some embodiments, a rapidly-deployable fire shelter is disclosed that is particularly well suited for use with vehicles and residential structures. Specifically, the fire shelter comprises a curtain-type barrier that is deployable under the force of expanding gas. The curtain-type barrier may comprise a plurality of panels connected to one another. The barrier may comprise a single volume that is filled with the expanding gas from the actuator or it may optionally comprise a tube frame.

The curtain-type barrier may be maintained in a housing while it is in a non-deployed state. The housing may be configured to attach above a window of a vehicle or above a window of a structure (e.g., the interior or exterior of the vehicle or house). In some embodiments, the housing is attached to or integrated with interior curtains or window treatments that are contained on the interior of a window frame.

The curtain-type barrier may also be provided with one or more securement mechanisms that enable the curtain-type barrier to be removable secured to the bottom of the window easily and efficiently. In some embodiments, the securement mechanisms may also enable the curtain-type barrier to replace an installed base of manually-deployable fire curtains. Specifically, a vehicle that was initially built with manually-deployable fire curtains that can be unfolded and temporarily secured around a vehicle window can be retrofitted with a fire shelter built in accordance with embodiments of the present disclosure. The securement mechanism also enables the curtain-type barrier to be used via manual deployment if the actuator becomes broken or is otherwise rendered inoperable.

In some embodiments a fire shelter is provided that generally comprises:

an inflatable protection barrier that is constructed with at least one of a fire-resistant and fire-retardant material, the inflatable protection barrier comprising at least one internal volume; and an actuator in fluidic communication with the at least one internal volume of the inflatable protection barrier, the actuator configured to discharge at least one of a gas and fluid into the at least one internal volume of the inflatable protection barrier.

The present invention will be further understood from the drawings and the following detailed description. Although this description sets forth specific details, it is understood that certain embodiments of the invention may be practiced without these specific details. It is also understood that in some instances, well-known circuits, components and techniques have not been shown in detail in order to avoid obscuring the understanding of the invention.

BRIEF DESCRIPTION OF THE DRAWINGS

The present disclosure is described in conjunction with the appended figures.

DETAILED DESCRIPTION

Figure 1:
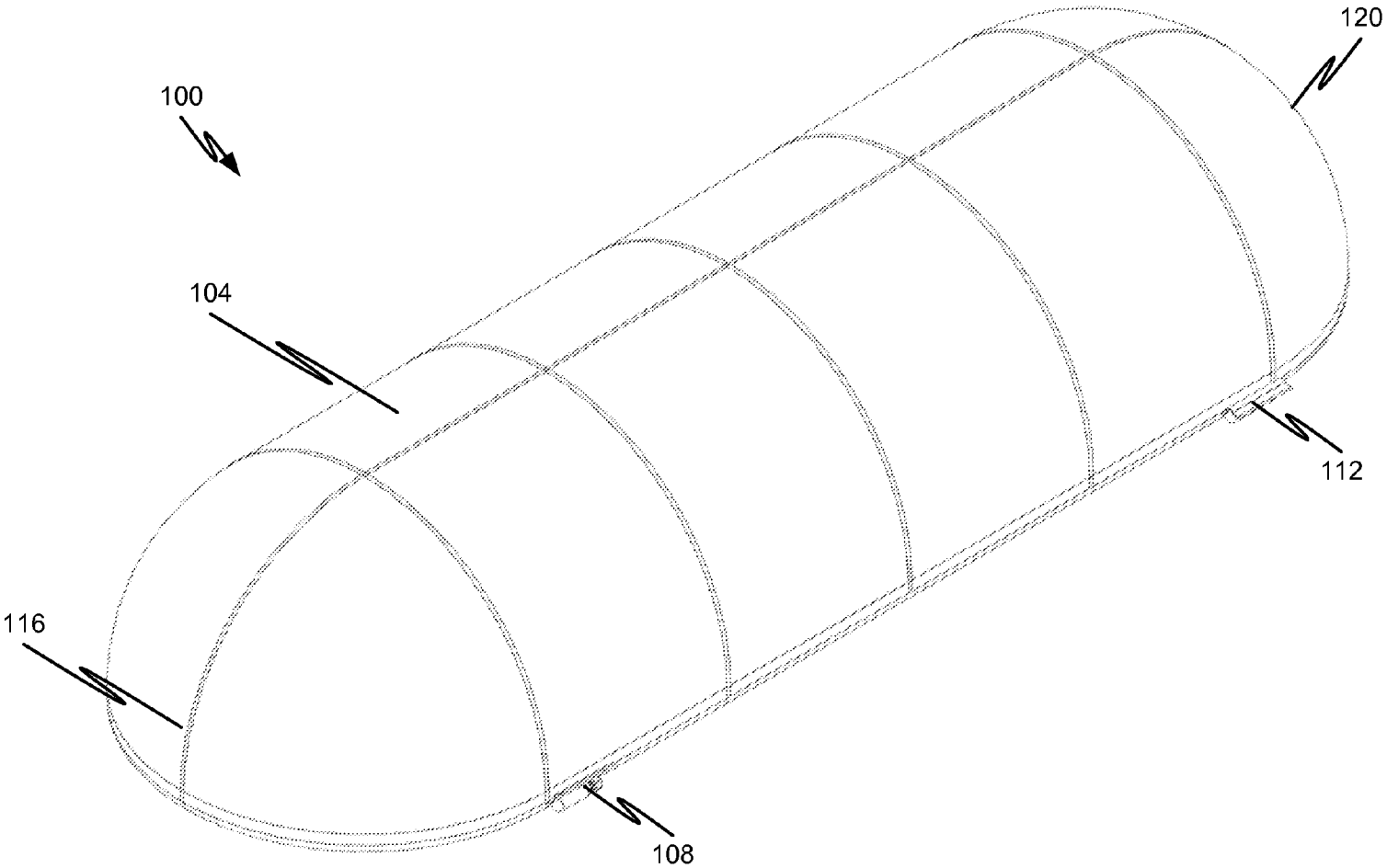
FIG. 1 is a top isometric view of a first embodiment of a deployed fire shelter in accordance with embodiments of the present disclosure.

The ensuing description provides embodiments only, and is not intended to limit the scope, applicability, or configuration of the claims. Rather, the ensuing description will provide those skilled in the art with an enabling description for implementing the described embodiments. It being understood that various changes may be made in the function and arrangement of elements without departing from the spirit and scope of the appended claims.

Referring initially to FIGS. 1-6 a first embodiment of a fire shelter 100 will be described in accordance with at least some embodiments of the present disclosure. The fire shelter 100, as seen in FIGS. 1-4 may be deployed so as to create a cavity for protecting a person or thing with a shell 104. In particular, the shell 104 and other components of the fire shelter 100 may comprise any type of material or collection of materials known to resist burning, withstand heat, and otherwise create a protective barrier against heat, flame, and other fire-related dangers. Either fire-retardant materials or fire-resistant materials may be used in the construction of the shell 104 and other components of the fire shelter 100. Fire-retardant materials are designed to burn slowly, in contrast to fire-resistant materials, which are designed not to burn at all. In other embodiments, the materials of the fire shelter 100 may be constructed of traditional materials (e.g., nylon, polyesters, elastane, cotton, cotton-polyester blends, rubber, combinations thereof, or any other material known to be used for clothing or for industrial applications) and then treated with fire-resistant or fire-retardant compounds.

More specifically, the shell 104 and other components of the fire shelter 100 may be made of a fire-retardant and/or fire-resistant material or be treated with a fire-retardant and/or fire-retardant material. Examples of suitable materials that may be used for the shell 104 and other components of the fire shelter 100 include, without limitation, Twaron, TARAMID®, NOMEX®, ARSELON®, coated nylon, carbon foam, M5 fiber, KEVLAR®, TARACOMFORT®, Proban fr cotton, PYROMEX®, Pyrovatex fr cotton, Dale Antiflame, Indura fr cotton, Technora, Teijinconex, Lenzing FR (fire retardant Rayon), Carbon X, Kanox, Mazic, Modacrylic, Kermel, polybenzimidazole fiber, CELAZOLE® PBI polymer, polyphosphazenes (especially those that bear aryloxy side groups), compounds that contain both phosphorus and nitrogen, and combinations thereof. Additional examples of fire-resistant and fire-retardant materials are described in further detail in U.S. Patent Publication Nos. 2007/0194289 to Anglin et al., 2002/0004127 to Bowers et al., 2006/0105658 to Patz et al., as well as U.S. Pat. No. 7,875,564 to Hsu et al., each of which are hereby incorporated herein by reference in their entirety.

Referring now to the structure of the fire shelter 100, the shelter 100 may include a number of components that enable the shell 104 to establish a protected area 216 or cavity adjacent to an inner surface of the shell 104. The opposing outer surface of the shell 104 may be configured to withstand flame, heat, and other fire-related dangers and may be specifically configured to protect any person or item within the protected area 216 from such fire-related dangers.

In some embodiments, the fully-deployed shell 104 may have a dome-like shape (e.g., half-cylindrical main portion with rounded ends) having dimensions sufficient to protect an average sized human. It should be appreciated, however, that the shape and size of the deployed shell 104 may vary according to intended uses and any such variations are considered to be within the scope of the present disclosure.

In some embodiments, the rapid deployment of the fire shelter 100 may be facilitated by one or more deployment mechanisms 108 and/or one or more deployment handles 112. The deployment mechanism 108 may be co-located with the deployment handle 112 or the two components may be at different locations on the shell 104.

In some embodiments, the deployment mechanism 108 comprises a source of compressed fluid or gas (e.g., compressed CO2, N2O, Helium, or the like). The deployment mechanism(s) 108 may be activated (e.g., caused to release the compressed fluid or gas) into the shell 104, thereby causing the shell 104 to expand and deploy.

In some embodiments, it may be desirable to provide multiple deployment mechanisms 108 on the fire shelter 100. Multiple deployment mechanisms 108 may enable a quicker deployment of the fire shelter 100 as well as redundancy for improved safety. Specifically, if one or more of the deployment mechanisms 108 fail to release their compressed fluid or gas (or fails for some other reason), then the other deployment mechanisms 108 are enabled to act as backups for the faulty deployment mechanisms.

The number of deployment mechanisms 108 employed may depend upon the structure of the shell 104. Specifically, if the shell 104 requires a relatively larger amount of gas or fluid to fully deploy, then a larger number of deployment mechanisms 108 (or larger capacity deployment mechanisms 108) may be utilized. On the other hand, if the shell requires a relatively smaller amount of gas or fluid to fully deploy, then a smaller number of deployment mechanisms 108 (or smaller capacity deployment mechanisms 108) may be utilized. The depicted embodiment shows the fire shelter 100 having two deployment mechanisms 108, each corresponding to a standard sized CO2 cartridge (e.g., 12 g or 16 g CO2 cartridge). It should be appreciated that a greater or lesser number of deployment mechanisms 108 (e.g., one, two, three, four, five, six, seven, or more) may be utilized without departing from the scope of the present disclosure. Similarly, larger or smaller deployment mechanisms 108 (e.g., 1 g, 2 g, 6 g, 8 g, 10 g, 14 g, 20 g, and other integer and non-integer sizes) may be employed depending upon the desired functionality of the fire shelter 100 and the number of deployment mechanisms 108 desired. It should also be appreciated that the number and size of deployment mechanisms 108 may vary depending upon the desired weight of the fire shelter 100. It may be desirable to utilize a minimal number of deployment mechanisms 108, thereby decreasing the weight of the fire shelter 100 since the fire shelter 100 will likely be carried by firefighters for extended periods of time.

Figure 2:
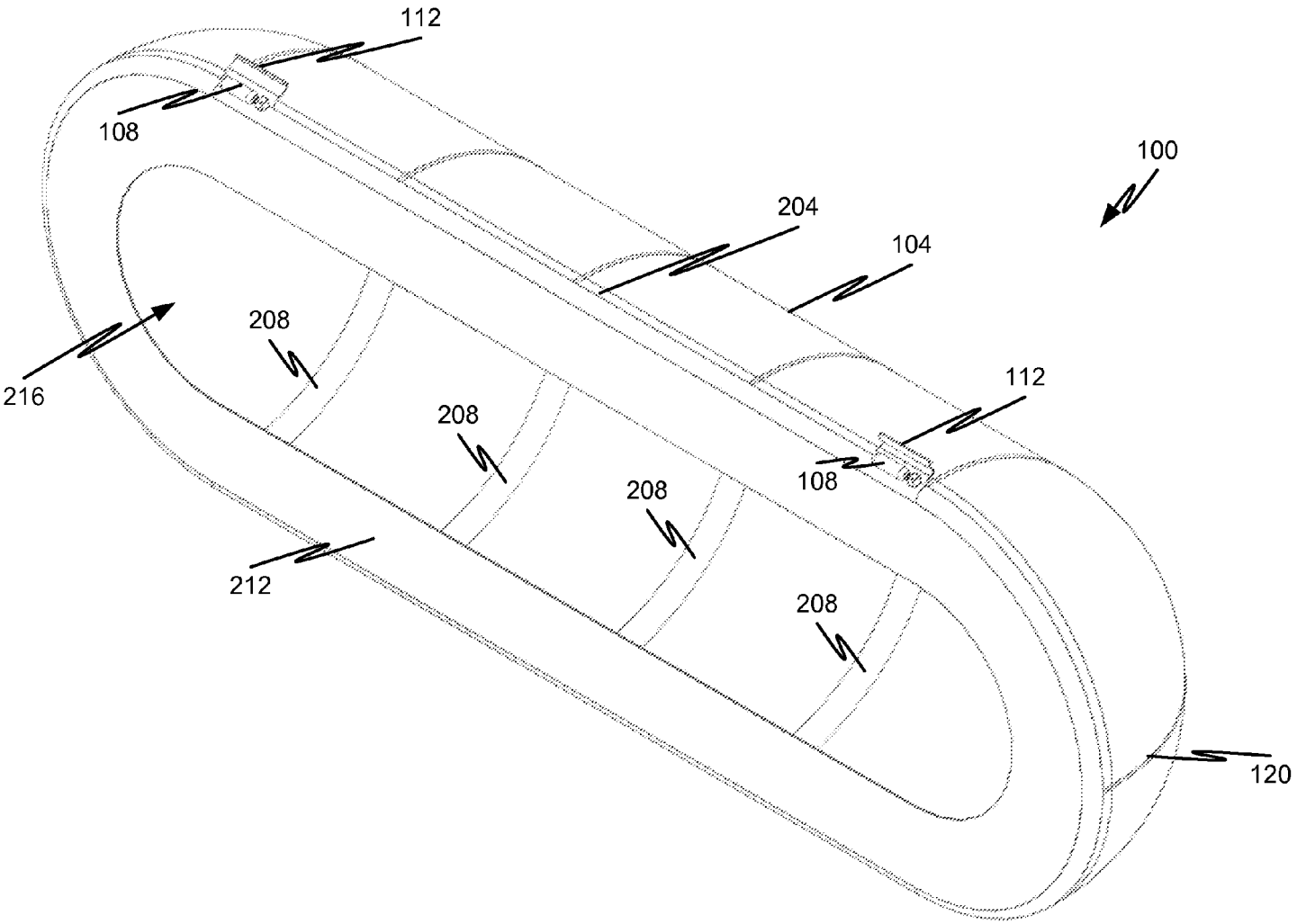
FIG. 2 is a bottom isometric view of the fire shelter depicted in FIG. 1.

As can be seen in FIG. 2, each deployment mechanism 108 is co-located with a deployment handle 112 at a shell perimeter 204. The shell perimeter 204 may define the outer boundary of the shell 104 and corresponds to the surface of the shell 104 that is placed on the ground to protect a person. Another reason it may be desirable to construct the shell 104 of flexible material is that such a construction enables the shell perimeter 204 to conform to a non-flat surface, thereby minimizing exposure of the protected area 216 to the outer environment. The flexible shell perimeter 204 is also useful to minimize air currents that flow into the protected area 216 when the shell 104 is deployed and the shell perimeter 204 is placed on the ground. By reducing air currents flowing into the protected area 216, the risk of flames entering the protected area 216 underneath the shell perimeter 204 is also reduced.

The shell perimeter 204 may also have a tongue 212 that is connected thereto which extends inward toward the protected area 216. The tongue 212 may provide several advantages. Firstly, the tongue 212 may provide a surface for a firefighter in the protected area 216 to hold the shell perimeter 204 onto the ground. Secondly, the tongue 212 may create a longer path between the outer surface of the shell 104 and the protected area 216, thereby making it more difficult for flames and heat to enter the protected area 216 when the shell perimeter 204 is placed on the ground.

The material used to construct the shell perimeter 204 and/or tongue 212 may be the same or different from the material used to construct the shell 104. In some embodiments, it may be desirable to use a thicker and more durable material for the tongue 212 as compared to the shell 104, since the tongue 212 will be the component that is in contact with the firefighter's hands/feet when in use.

Figure 3:
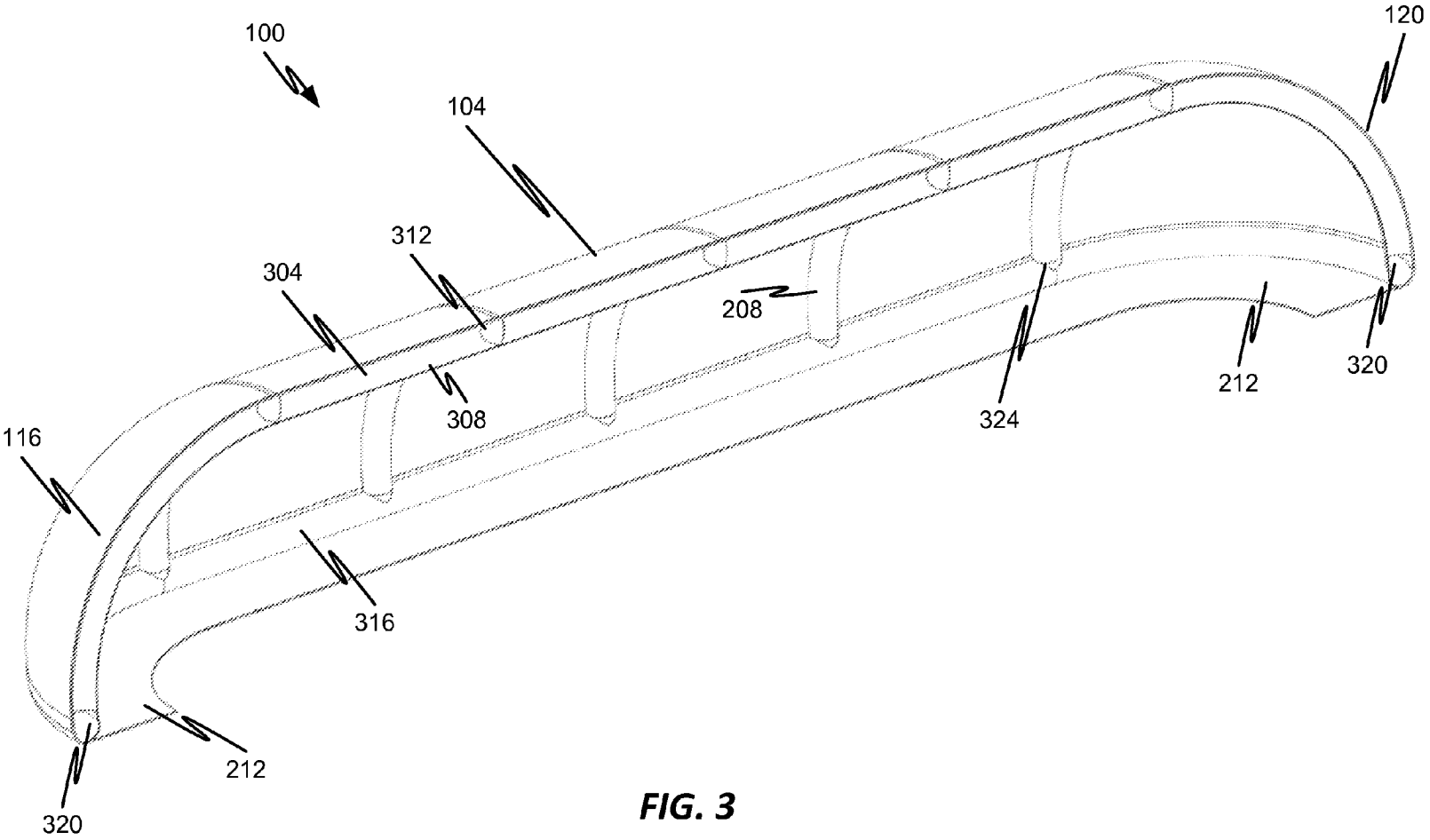
FIG. 3 is a cross-sectional isometric view of the fire shelter depicted in FIG. 1.

With reference now to FIGS. 2 and 3, one example construction of the shell 104 and shell perimeter 204 will be described in accordance with embodiments of the present disclosure. Although this construction corresponds to one suitable manner for constructing the shell 104 and shell perimeter 204, those of ordinary skill in the art will appreciate that other constructions can be employed without departing from the scope of the present disclosure. As an example, rather than having a tubular construction as is shown in FIGS. 2 and 3, the shell 104 may comprise a single void between an outer and inner layer and the entirety of the void may be filled with a gas and/or liquid to deploy the fire shelter 100.

In some embodiments, the shell 104 may comprise a plurality of inflatable cross members 208 that extend from one point on the shell perimeter 204 across the top of the shell 104 to another point on the shell perimeter 204. The shell perimeter 204 may comprise an inflatable perimeter member 316 that spans the entirety of the shell perimeter 204. Each inflatable cross member 208 may intersect the inflatable perimeter member 316 at two cross member intersections 324.

The shell 104 may also comprise a main inflatable cross member 204 that extends from the first end 116 of the shell 104 to the second end 120 of the shell 104. The main inflatable cross member 204 may bisect each of the other inflatable cross members 208. Each point of bisection may correspond to a cross member intersection 312 that is located at the uppermost point of the shell 104. The main inflatable cross member 204 may also intersect the inflatable perimeter member 316 at perimeter intersections 320. In some embodiments, the main inflatable cross member 304 bisects each inflatable cross member 208 and the inflatable perimeter member 316 at an orthogonal angle.

As can be appreciated, the main inflatable cross member 204 does not necessarily have to span the longest length of the shell 104, although it may be desirable to provide such a configuration so as to maximize the structural integrity of the shell 104 when the inflatable members 304, 308, 324 are inflated. Furthermore, more than one main inflatable cross member 304 may be employed without departing from the scope of the present disclosure. Similarly, a greater or lesser number of inflatable cross members 308 (e.g., one, two, three, four, five, six, or more) may be employed without departing from the scope of the present disclosure.

In some embodiments, each of the inflatable members 304, 308, 324 are connected to one another, thereby creating a single common volume (albeit distributed in a tubular fashion) that can be filled with expanding gases from the deployment mechanism(s) 108. In some embodiments, however, it may be desirable to create divisions or sections in the inflatable frame and each section may have its own dedicated deployment mechanism 108 such that if one section (e.g., the middle section) does not inflate or has otherwise become compromised due to a tear, the other sections (e.g., the end sections) may still inflate and deploy. Such a deployed fire shelter 100, while not optimal, may still provide a sufficient amount protection to a firefighter within the protected area 216.

In some embodiments, the deployment mechanisms 108 may further be equipped with pressure release valves 604 (see FIG. 6) that enable expanding gases to escape from the inflatable members 304, 308, 324 when pressures within the inflatable members 304, 308, 324 exceed a predetermined pressure. Specifically, the inflatable members 304, 308, 324 will have gases therein while the fire shelter 100 is deployed and exposed to flame and heat. This exposure may cause the gases within the inflatable members 304, 308, 324 to further expand, thereby increasing the pressure within the inflatable members 304, 308, 324. The pressure release valves 604 may provide the means for maintaining an acceptable pressure within the inflatable members 304, 308, 324 to ensure that the fire shelter does not burst due to the expanding gases.

In some embodiments, the shell 104 is longer in one dimension (e.g., a dimension spanning from a first end 116 of the shell 104 to a second end 120 of the shell 104) than another dimension. Specifically, as can be seen in FIG. 4B, the deployed shell 104 may have a length L from the first end 116 to the second end 120. The length L may be specifically designed to be at least as long as an average size male or female. In some embodiments, the length L of the shell 104 may be anywhere between 5 feet and 8 feet and more specifically may be between 6 feet and 7 feet. Even more specifically, the length L of the shell 104 may be about 7 feet.

Figure 4A:
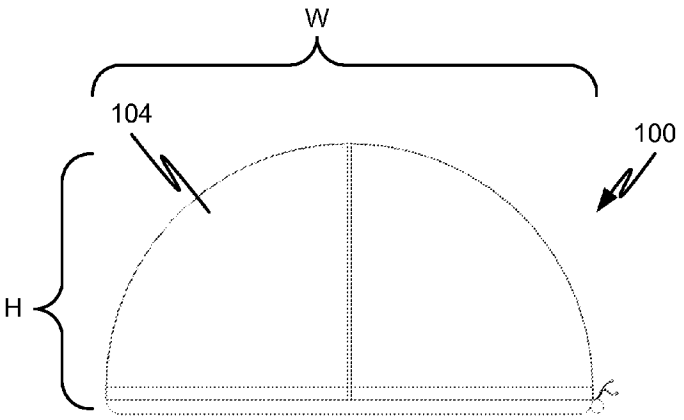
FIG. 4A is an end view of the fire shelter depicted in FIG. 1.
Figure 4B:
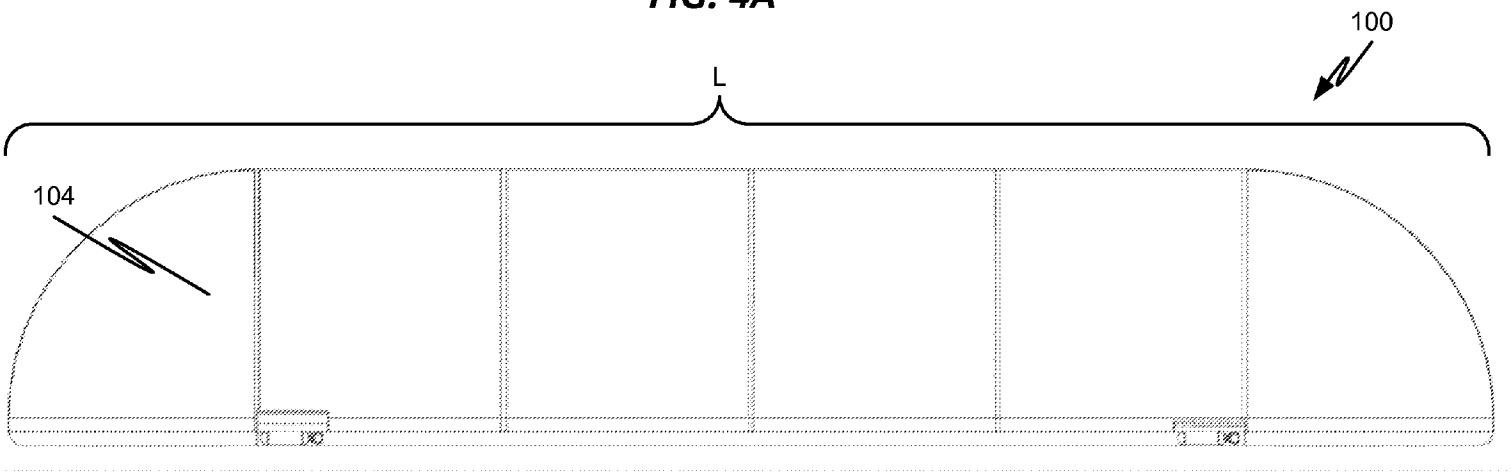
FIG. 4B is a side view of the fire shelter depicted in FIG. 1.

Similar to the length L, and as can be seen in FIG. 4A, the deployed shell 104 may have a height H and width W sufficient to protect an average size male or female. In some embodiments, the height H of the shell 104 may be anywhere between 1 foot to 4 feet and more specifically may be between 2 feet and 3 feet. Even more specifically, the height H of the shell 104 may be about 2.5 feet. The width W of the shell 104 may be anywhere between 2 feet and 5 feet and more specifically may be between 3 feet and 4 feet. Even more specifically, the width W of the shell 104 may be about 3.5 feet.

Figure 5:
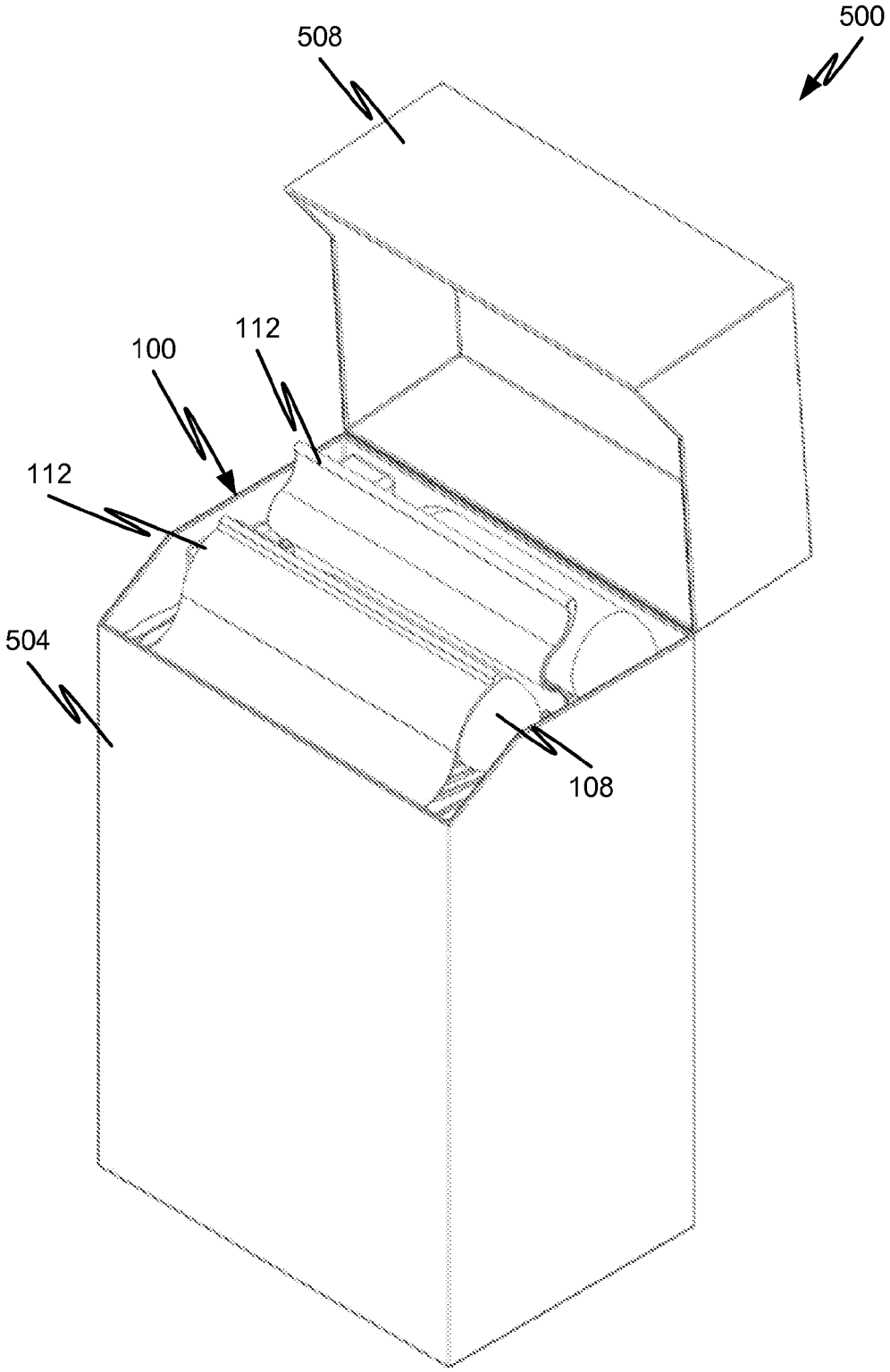
FIG. 5 is an isometric view of a container for a fire shelter in accordance with embodiments of the present disclosure.
Figure 6:
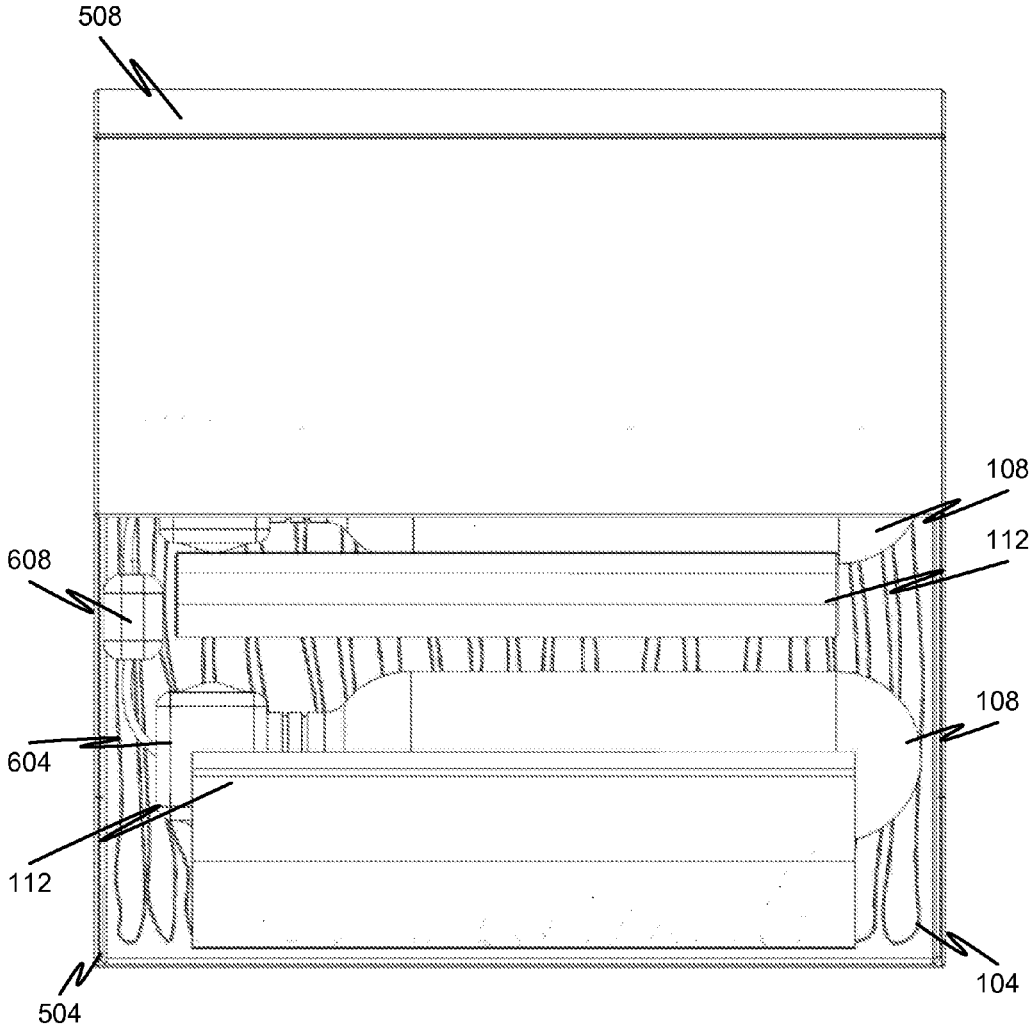
FIG. 6 is a top view of the container depicted in FIG. 5.
Figure 7:
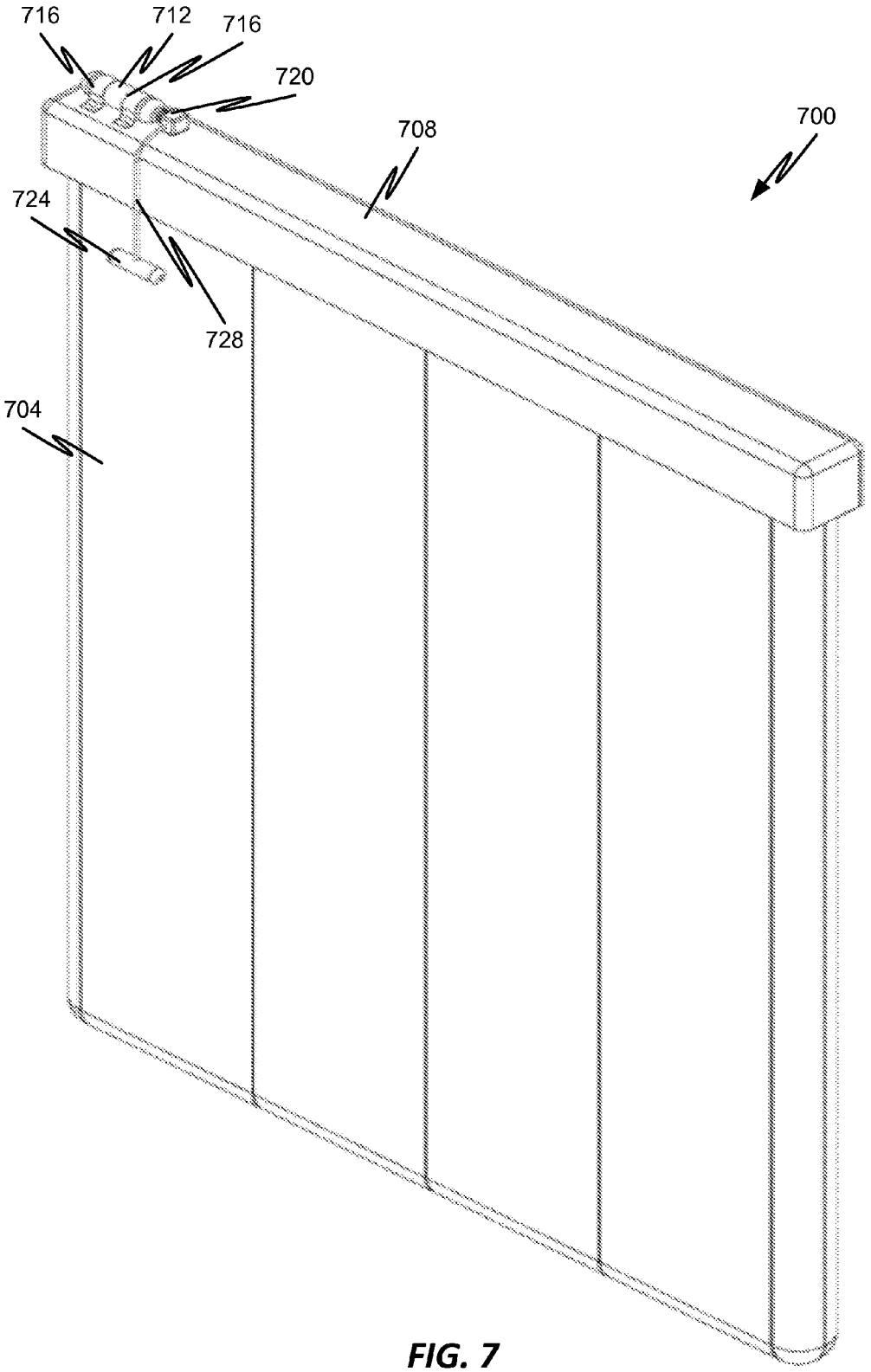
FIG. 7 is a top isometric view of a second embodiment of a deployed fire shelter in accordance with embodiments of the present disclosure.

As can be seen in FIGS. 5 and 6, the fire shelter 100, when not deployed, may be contained within a carrying case 504 or similar package. The combination of the fire shelter 100 and case 504 may be referred to as a fire shelter system 500. Although the case 504 is depicted as a backpack or similar type of container, it should be appreciated that any suitable type of container may be used as a case for the fire shelter 100. It is not necessary that the case 504 be configured for carrying by a firefighter, although such a configuration may be particularly useful in certain situations. Rather, it may also be possible to provide a case 504 that is configured to be attached to a vehicle, carried by some non-human animal (e.g., horse, dog, etc.).

In some embodiments, the case 504 comprises a main body and a lid 508. The lid 508 may open on a hinge or at a single seam such that the deployment handles 112 are exposed at the top of the case 504. A user of the fire shelter 100 may grasp the deployment handles 112 and pull the fire shelter 100 out of the case 504. As the deployment handles 112 are pulled out of the case, the handles 112 may also be pulled apart, thereby causing the deployment mechanisms 108 to expel the gas or fluid contained therein into the shell 104. Specifically, the deployment mechanisms 108 may be fluidically connected to the interior volume of the inflatable members 304, 308, 324 via one or more fittings 608. The fittings 608 may provide a connection between the inflatable members and a fluid line that extends from the deployment mechanism 108. Any type of known trigger mechanism (e.g., trigger line, switch, pressure applicator that pierces the deployment mechanism 108, etc.) may be used to trigger the activation of the deployment mechanism(s) 108.

With reference now to FIGS. 7-12, a second embodiment of a fire shelter 700 will be described in accordance with at least some embodiments of the present disclosure. The fire shelter 700 may comprise a curtain 704 that is attached to a housing 708. In some embodiments, the fire shelter 700 may be configured for deployment over a window or opening of a vehicle (e.g., car, truck, SUV, van, jeep, bus, etc.), house, building, or similar structure. As can be appreciated, the fire shelter 700 may have components that are similar or identical to fire shelter 100, except that fire shelter 700 is configured to deploy a curtain 704 rather than a shell 104. The materials discussed in connection with fire shelter 100 may also be employed to construct the fire shelter 700 or components thereof.

It is considered to be within the scope of the present disclosure to have fire shelter 700 employ one or more components described in connection with fire shelter 100 and vice versa. For ease of understanding, however, a single embodiment of fire shelter 700 will be described.

In some embodiments, the fire shelter 700 comprises one or more deployment mechanisms 712 that are attached to the housing 708 via one or more fasteners 716. The deployment mechanism 712 may be similar or identical to deployment mechanism 108. The fasteners 716 may be configured to secure the deployment mechanism 712 to one or more surfaces of the housing 708. It should be appreciated that any type of known mechanical fastener (e.g., c-clamp, screw, bolt, nail, tack, string, wire, friction fitting, etc.), adhesive, epoxy, or combinations thereof can be used as the fastener 716.

The deployment mechanism 712 may be fluidically connected to the void of the curtain 704 via a fitting 720. In some embodiments, the fitting 720 is similar or identical to the fitting 608. Although not depicted, the deployment mechanism 712 may also comprise a release valve to control the amount of pressure that exists within the curtain 704. Also similar to the fire shelter 100, the deployment mechanism 712 may be activated mechanically by a deployment handle 724 that is connected to the fitting 720 via a deployment line 728. As will be discussed in further detail below, other mechanical, electro-mechanical, and electrical activation mechanisms can be used to activate the deployment mechanism 712 or 108.

Figure 8:
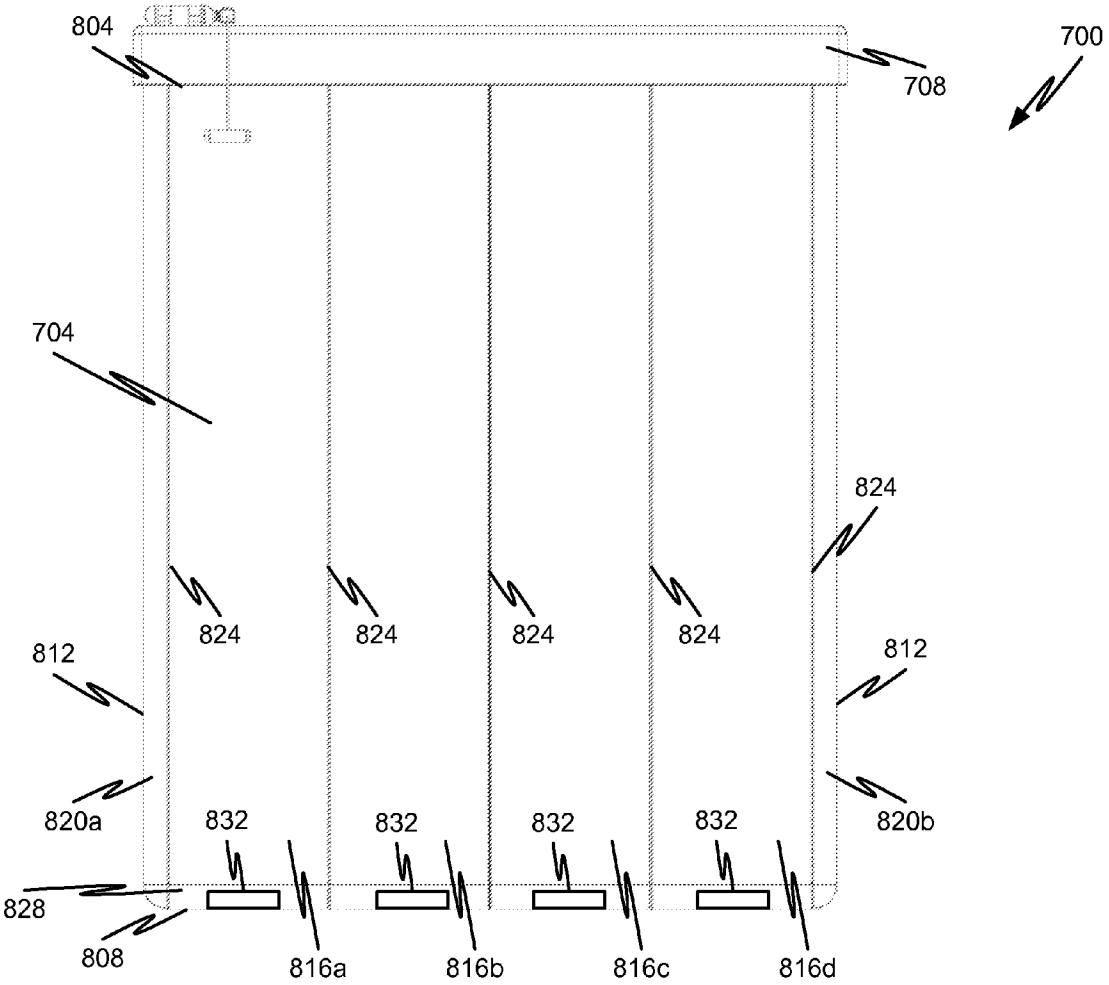
FIG. 8 is a front view of the fire shelter depicted in FIG. 7.
Figure 9:
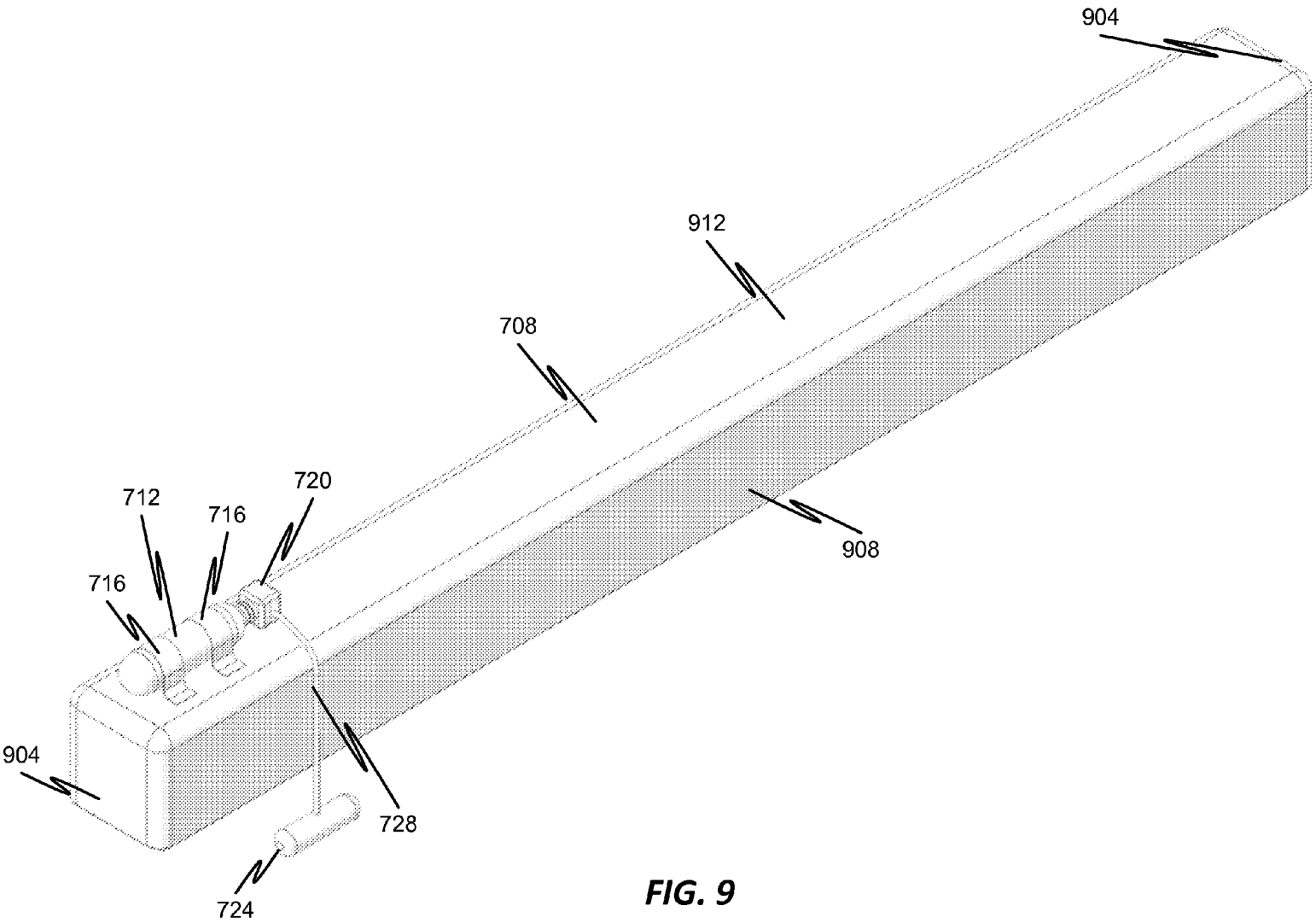
FIG. 9 is a top isometric view of the fire shelter depicted in FIG. 7 prior to deployment.
Figure 10A:
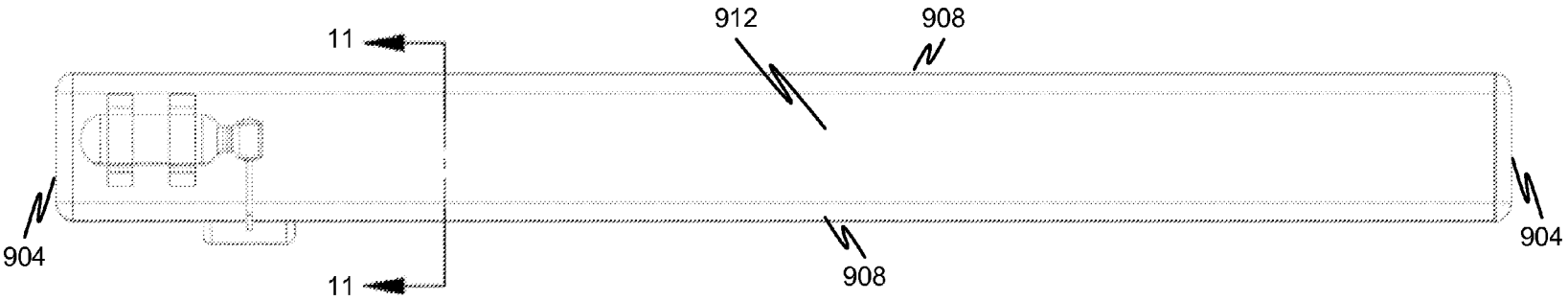
FIG. 10A is a top view of the fire shelter depicted in FIG. 9.
Figure 10B:
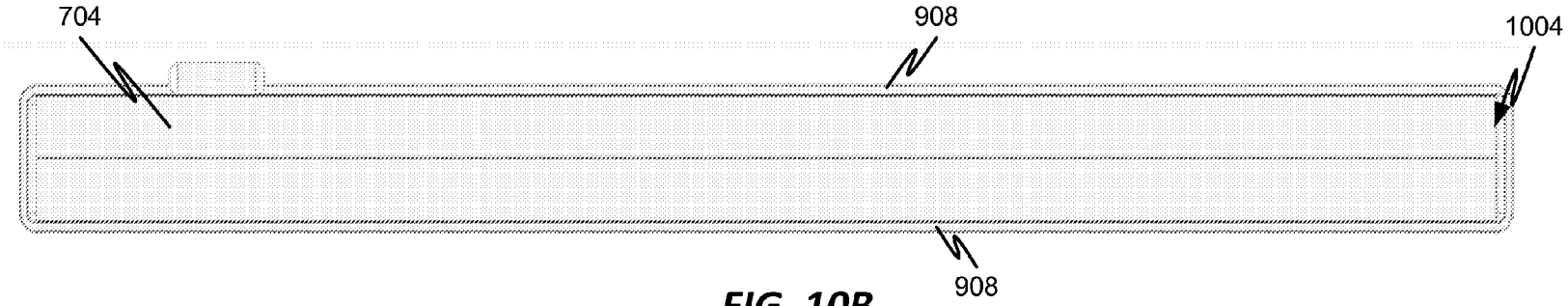
FIG. 10B is a bottom view of the fire shelter depicted in FIG. 9.
Figure 11:
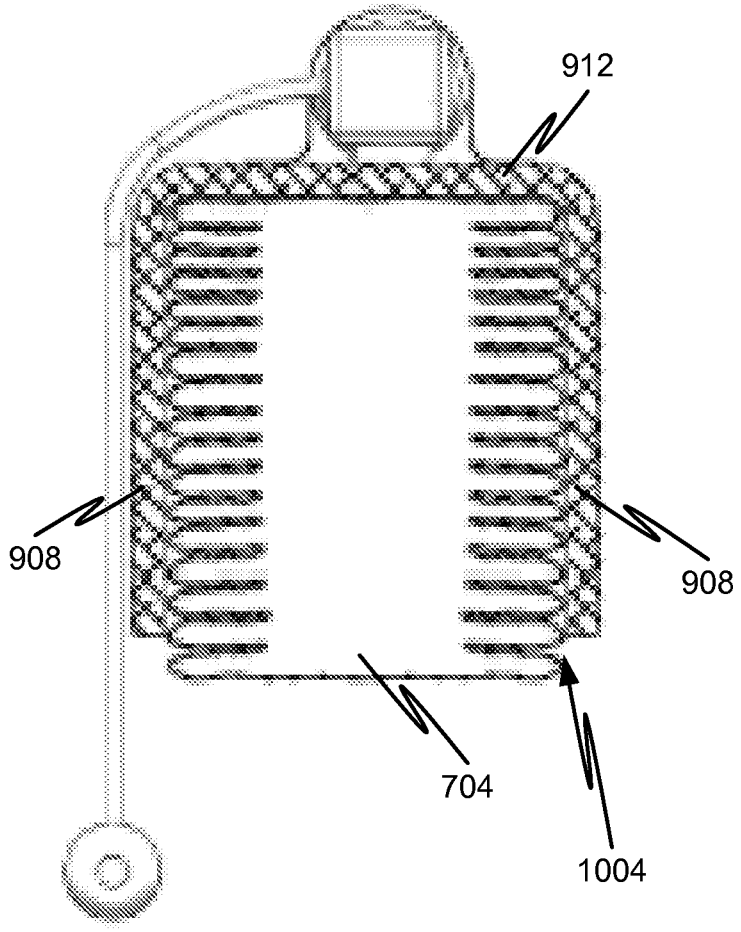
FIG. 11 is a cross-sectional view across line 11-11.

Referring specifically now to FIG. 8, additional details of the curtain 704 in a deployed state will be described in accordance with embodiments of the present disclosure. In some embodiments, the curtain 704 may either have a tubular construction similar to the shell 104 or it may have a sheet-like construction where a large single void exists between a front and back layer of the curtain. As the tubular construction has already been discussed in connection with the shell 104, a sheet-like construction will be described in connection with the curtain 704, although it should be appreciated that a tubular construction is also acceptable for the curtain 704.

One advantage that can be exploited by the curtain 704 that may not be available to the shell 104, is that the curtain 704 can be deployed with the assistance of gravitational forces whereas the shell 104 may need to be deployed upward and against gravitational forces. With this in mind, it may be desirable to utilize a sheet-like construction for the curtain 704 where more material is used and the weight of that material can be leveraged to assist the deployment of the curtain 704 with expanding gases or liquids being provided from the deployment mechanism 712.

In some embodiments, the curtain 704 comprises a top end 804 and a bottom end 808 that are connected to one another via two sides 812. The lengths of the sides 812 may be the same, although such a configuration is not required. Of course, the dimensions of the curtain 704 may be specifically tailored to any opening that is being protected. Accordingly, the curtain 704 may comprise more than two sides 812, multiple bottom ends 808, and may be in any shape.

The curtain 704 may comprise a main interior surface and opposing main exterior surface that are connected to one another via one or more end panels 820*a*, 820*b*. Each main surface may comprise one or more curtain panels (e.g., 816*a*-*d*). The curtain panels on one main surface may be separated from the curtain panels on the opposing main surface such that gas or liquid expelled from the deployment mechanism 712 fills the void between the curtain panels. It should be appreciated that while the curtain 704 is depicted as having four curtain panels 816*a*, 816*b*, 816*c*, 816*d*, a greater or lesser number of panels may be provided on each main surface of the curtain 704 without departing from the scope of the present disclosure.

A seam 824 or similar type of material joint may be established between each curtain panel. Furthermore, a seam 824 may connect a curtain panel with an end panel 820*a*, 820*b*. Meanwhile, a seam 824 may connect the bottom of each curtain panel to a bottom panel 828 that is provided at the bottom end 808 of the curtain 704. The bottom panel 828 may also comprise one or more securement mechanisms 832 that enable the bottom panel 828 to be secured to an appropriate counterpart that is situated on the protected vehicle, structure, house, etc. The nature of the securement mechanism 832 may depend upon the type of counterpart that is being connected to. In particular, the securement mechanism 832 may comprise one half of a hook and loop material whereas the counterpart on the protected item may comprise the other half of the hook and loop material. Alternatively, or in addition, the securement mechanism 832 may comprise a magnetized material that enables the bottom panel 828 to be releasably attached to a metal surface. Alternatively, or in addition, the securement mechanism 832 may comprise a snap, button, adhesive, or the like to enable securement of the bottom panel 828 to a bottom portion of a window or the like.

As can be seen in FIGS. 9-12, the curtain 704 may be contained within the housing 708 when the curtain 704 is not deployed. Activation of the deployment mechanism 712 may cause downward forces to be exerted on the curtain 704 such that the curtain 704 extends out of the housing 708.

The housing 708 may be dimensioned to fit over or within a window, opening, or other type of exposed point in a vehicle, building, house, etc. As some examples, the housing 708 may comprise two ends 904 that are connected by two side surfaces 908 and a top surface 912. The bottom of the housing 708 may comprise a housing cavity 1004 that receives the curtain 704 and stores the curtain 704 in a compressed or folded state.

Although not depicted, the housing 708 may be provided with one or more mounting brackets that facilitate the mounting of the housing 708 over or within a predetermined opening of a vehicle, structure, or house. Any type of known mounting bracket or similar mounting mechanism (e.g., plate and screw, hooks, friction fittings, etc.) used to mount curtains, blinds, shutters, or the like over or within a window frame may be employed to mount the housing 708 into the desired position without departing from the scope of the present disclosure.

Figure 12:
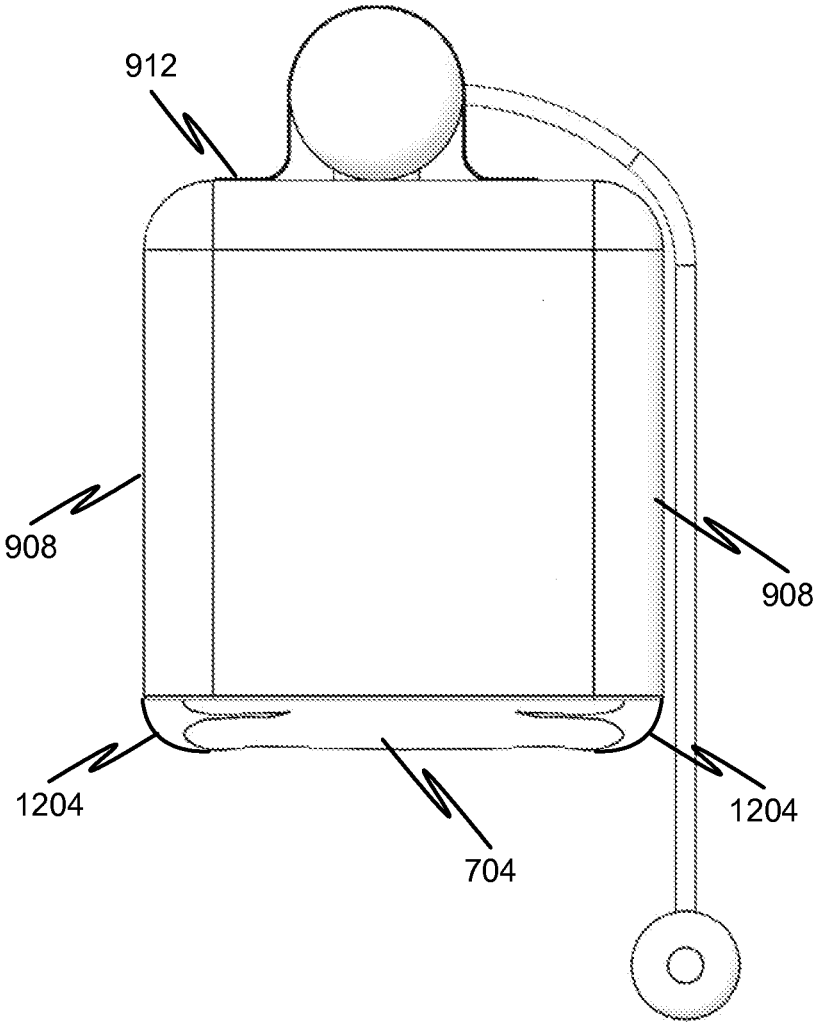
FIG. 12 is an end view of the fire shelter depicted in FIG. 9.

FIG. 12 also depicts the housing 708 with one or more retainers 1204 that are located at the bottom end of the housing 708. The retainers 1204 may be connected to or part of the sides 908 or ends 904. One, two, three, four, or more retainers 1204 may be used to retain the curtain 704 within the housing cavity 1004. The retainers 1204 may comprise any type of material (e.g., metal, wood, polymer, ceramic, composite, etc.) that is either rigidly attached or hingedly attached to the bottom of housing 708. The retainers 1204 may be configured to retain the weight of the curtain 704 but give way (e.g., open, pivot, break, etc.) when a gas or liquid is introduced into the void of the curtain 704 by the deployment mechanism 712. The additional force of the gas or fluid expanding the curtain 704 may cause the curtain 704 to force itself past the retainers 1204 and deploy away from the housing 708.

Figure 13:
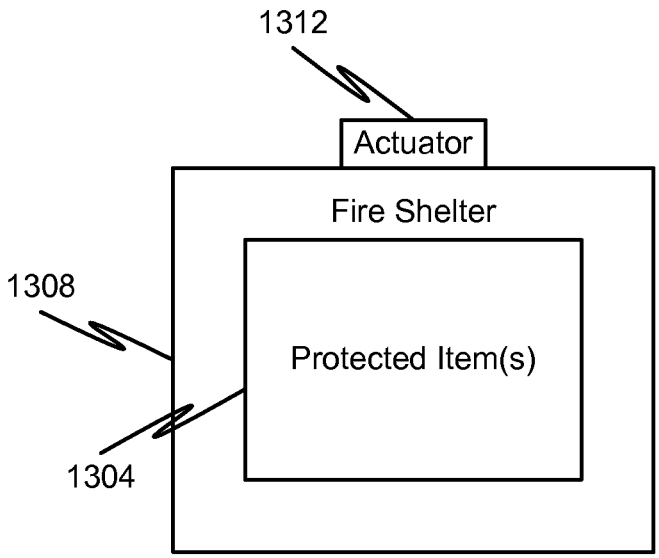
FIG. 13 is a block diagram depicting a first configuration of a fire shelter and actuator in accordance with embodiments of the present disclosure.
Figure 14:
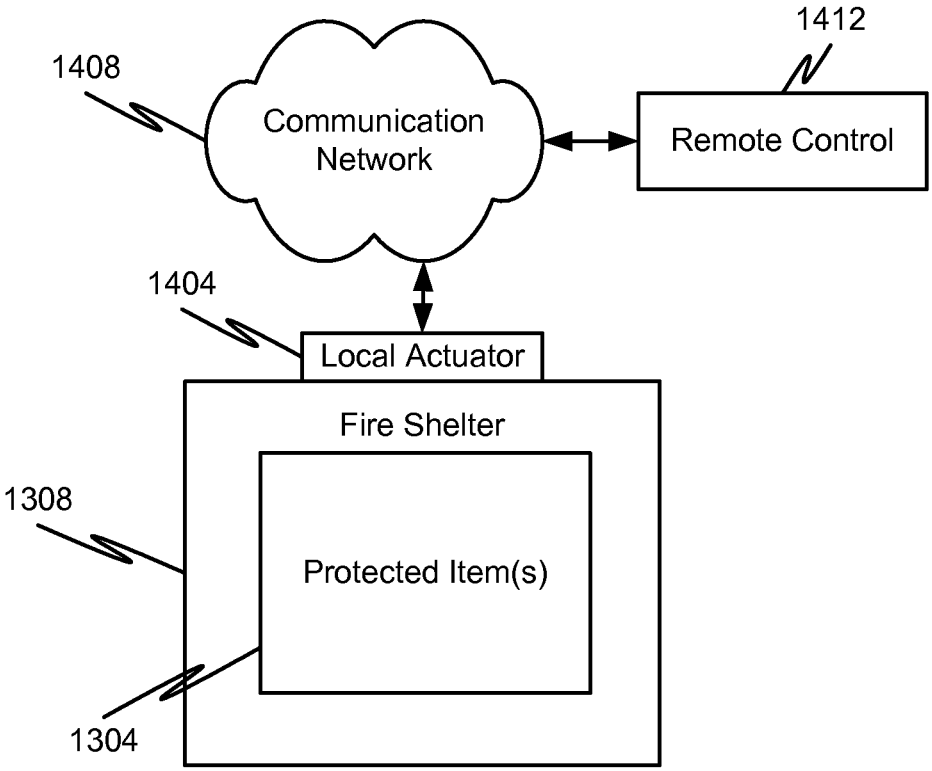
FIG. 14 is a block diagram depicting a second configuration of a fire shelter and actuator in accordance with embodiments of the present disclosure.
Figure 15:
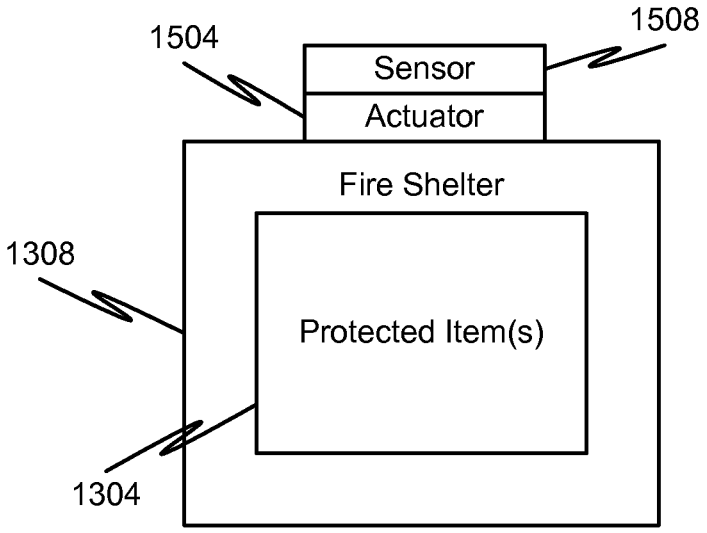
FIG. 15 is a block diagram depicting a third configuration of a fire shelter and actuator in accordance with embodiments of the present disclosure.

With reference now to FIGS. 13-15, variations of the deployment mechanisms 108, 712 and/or triggers therefore will be described in accordance with embodiments of the present disclosure. In particular, various types of actuators will be described that can be similar or identical to the deployment mechanisms 108, 712 discussed hereinabove. An actuator may refer to any component or collection of components that cause the fire shelter 100, 700 to transition from an undeployed state to a deployed state (e.g., by forcing gas or fluid into an expandable void in a shell 104 or curtain 704). The actuator may comprise purely mechanical components or a combination of mechanical and electrical components. A simple actuator 1312 is depicted in FIG. 13 that is directly connected to the fire shelter 1308. This particular example of an actuator 1312 may correspond to a mechanically-activated actuator that causes the fire shelter 1308 to deploy and protect a protected item 1304. As discussed above, the protected item(s) 1304 may be completely enclosed by the fire shelter 1308 or it may only be partially covered by the fire shelter 1308. The actuator 1312 may correspond to a deployment mechanism 108, 712 that is activated by a handle, button, key, lever, or any other physical force applied in proximity to the actuator 1312.

FIG. 14 shows an example of a local actuator 1404 that is in communication with a remote control 1412 via a communication network 1408. It should be appreciated that the communication network 1408 is optional and the remote control 1412 may be configured to communicate wirelessly (e.g., via Bluetooth, RF signals, infrared signals, visible light, sound waves, etc.) with the local actuator 1404. If the communication network 1408 is not employed, then there may be a requirement that the remote control 1412 be within a predetermined distance (e.g., Bluetooth read range, RF read range, line-of-sight, etc.) of the local actuator 1404 to activate the local actuator 1404. The communication network 1408, on the other hand, enables the remote control 1412 to communicate with the local actuator 1404 at extended distances.

The communication network 1408 may comprise any type of known communication medium or collection of communication media and may use any type of protocols to transport messages between endpoints. The communication network 1408 may include wired and/or wireless communication technologies. The Internet is an example of the communication network 1408 that constitutes an Internet Protocol (IP) network consisting of many computers, computing networks, and other communication devices located all over the world, which are connected through many telephone systems and other means. Other examples of the communication network 1408 include, without limitation, a standard Plain Old Telephone System (POTS), an Integrated Services Digital Network (ISDN), the Public Switched Telephone Network (PSTN), a Local Area Network (LAN), a Wide Area Network (WAN), a Session Initiation Protocol (SIP) network, a cellular network, a satellite network, and any other type of packet-switched or circuit-switched network known in the art. In addition, it can be appreciated that the communication network 1408 need not be limited to any one network type, and instead may be comprised of a number of different networks and/or network types.

When a communication network 1408 is employed, the local actuator 1404 and remote control 1412 may both comprise one or more network interfaces (e.g., Network Interface Cards, wireless antennas, drivers, network ports (e.g., Ethernet, USB, etc.), and the like). Alternatively, the local actuator 1404 and/or remote control 1412 may be in communication with a separate network adaptor.

In some embodiments, the remote control 1412 may be used to transmit one or more signals or messages to the local actuator 1404 (either directly or via the communication network 1408). The local actuator 1404 or a component in communication therewith may comprise a processor that is capable of processing and interpreting the signal/message received from the remote control 1412. Upon receiving and processing the appropriate signal or message, the local actuator 1404 may execute one or more actions that are consistent with the signal or message. Examples of such actions include activating the local actuator 1404, thereby causing the fire shelter to deploy, sounding an alarm that indicates the fire shelter will be deployed or has been deployed, lighting an indicator that indicates the fire shelter will be deployed or has been deployed, and so on.

FIG. 15 shows another example of an actuator 1504 that is in communication with a sensor 1508. Much like the remote control 1412 and local actuator 1404, the sensor 1508 and actuator 1504 may be in direct electrical communication (e.g., via wires, conductive traces, etc.), direct wireless communication, or indirect communication via a communication network. In some embodiments, the sensor 1508 may be secured or affixed to the fire shelter in a position that is substantially near the actuator 1504.

If the sensor 1508 detects one or more predetermined environmental conditions (e.g., temperatures in excess of a predetermined temperature, infrared activity in excess of a predetermined activity threshold, etc.) that are likely to correspond to flames or heat, the sensor 1508 may automatically activate the actuator 1504. Alternatively, the sensor 1508 and actuator 1504 may be part of a Programmable Logic Circuit (PLC) that controls when the actuator 1504 is activated and the fire shelter is deployed based on inputs received from the sensor 1508.

As discussed above, the sensor 1508 may employ any fire or heat-sensing technology. Examples of suitable sensors 1508 include, without limitation, an ultraviolet flame detector, a visible light flame detector (e.g., camera and image-processing module), an infrared sensor, a smoke detector, a thermostat/thermometer, or combinations thereof.

Figure 16:
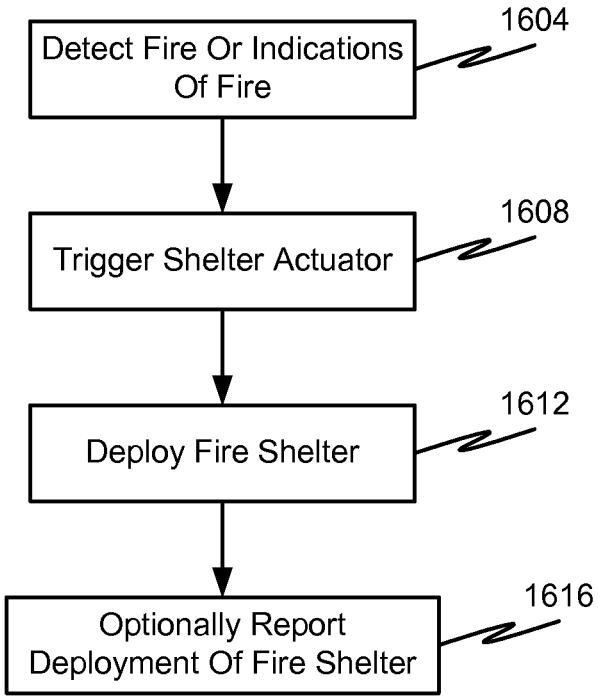
FIG. 16 is a flow diagram depicting a fire shelter deployment method in accordance with embodiments of the present disclosure.

With reference now to FIG. 16, a method of deploying a fire shelter with any one or more of the actuators/deployment mechanisms discussed hereinabove will be described in accordance with embodiments of the present disclosure. The method is initiated when fire or indications of fire are detected (step 1604). This step may occur automatically (e.g., with sensor 1508) or with human assistance.

Upon detecting fire or indications of fire, the method continues by triggering the actuator (step 1608). Depending upon the type of actuator employed and other considerations, the manner in which the actuator is deployed can vary. For example, the actuator may be triggered manually with a user pulling a lever, pushing a button, pulling a handle, etc. Alternatively, or in addition, a user may trigger the actuator remotely. Alternatively, or in addition, a combination of the embodiments described in FIGS. 14 and 15 may be employed and a user may be separated from the fire shelter but notified of a detected fire condition near the fire shelter. Upon receiving such a notification, the user may be asked if they want to deploy the fire shelter. A positive response to such a query may result in the remote control 1412 transmitting a signal or message to the local actuator 1404, thereby causing the local actuator 1404 to activate and deploy the fire shelter. A negative response to such a query may result in no transmission of instructions from the remote control 1412. The user may also preprogram rules to handle the situation where they don't respond within a predetermined amount of time of receiving such a notification. Specifically, a user can administer rules that cause the local actuator 1404 to become activated or not after a predetermined amount of time has passed since detecting fire or indications of fire.

Once the actuator has been triggered (e.g., activated), the method continues with the actuator causing the fire shelter to become deployed (step 1612). Deployment of the fire shelter can be accomplished by projecting a gas or liquid into the shell or curtain of the fire shelter, thereby causing the shape of the shell or curtain to change until it is fully deployed.

An addition step that may be performed either before or after the deployment of the fire shelter is a reporting or indicating step (step 1616). Specifically, it may be possible to report that a fire shelter has been deployed for safety and inventory purposes. It may also be possible to indicate that a fire shelter is about to be deployed, thereby giving persons within proximity of the fire shelter the ability to stand clear of the fire shelter.

In the foregoing description, for the purposes of illustration, methods were described in a particular order. It should be appreciated that in alternate embodiments, the methods and steps thereof may be performed in a different order than that described. It should also be appreciated that the methods described above may be performed by hardware components or may be embodied in sequences of machine-executable instructions, which may be used to cause a machine, such as a general-purpose or special-purpose processor or logic circuits programmed with the instructions to perform the methods. These machine-executable instructions may be stored on one or more machine readable mediums, such as CD-ROMs or other type of optical disks, floppy diskettes, ROMs, RAMs, EPROMs, EEPROMs, SIMs, SAMs, magnetic or optical cards, flash memory, or other types of machine-readable mediums suitable for storing electronic instructions. Alternatively, the methods may be performed by a combination of hardware and software.

While illustrative embodiments of the disclosure have been described in detail herein, it is to be understood that the inventive concepts may be otherwise variously embodied and employed, and that the appended claims are intended to be construed to include such variations, except as limited by the prior art.

What is claimed is:

1. A fire shelter, comprising:

an inflatable protection barrier that is constructed with at least one of a fire-resistant and fire-retardant sheet of material, the inflatable protection barrier further comprising a single inflatable internal volume attached to the sheet of material such that when the inflatable internal volume is inflated the sheet of material is deployed to establish a protected cavity adjacent to an inner surface of the sheet of material, wherein the sheet of material further includes an open bottom which enables a person to enter the protected cavity and further enables cooling effects from ground to enter the protected cavity, wherein the inflatable protection barrier comprises a shell perimeter extending around the protected cavity along the open bottom, the shell perimeter comprising a tongue circumscribing the shell perimeter and which extends inwardly beginning at the shell perimeter toward the protected cavity and open bottom; and an actuator in fluidic communication with the inflatable internal volume of the inflatable protection barrier, the actuator configured to discharge at least one of a gas and fluid into the inflatable internal volume of the inflatable protection barrier to deploy the sheet of material.

2. The fire shelter of claim 1, wherein the at least one of a gas and fluid comprises a gas that is maintained in a compressed state in the actuator.

3. The fire shelter of claim 1, wherein the actuator comprises a release valve that allows gases in the inflatable internal volume to escape the inflatable internal volume when pressures within the inflatable internal volume exceed a predetermined pressure.

4. The fire shelter of claim 2, wherein the gas comprises at least one of CO2, N2O, and Helium.

5. The fire shelter of claim 1, wherein the actuator comprises at least one of a mechanical and electro-mechanical trigger mechanism.

6. The fire shelter of claim 1, wherein the inflatable protection barrier, when deployed, comprises a half-cylindrical main portion with a first rounded end and a second rounded end and wherein the open bottom extends from the first rounded end to the second rounded end.

7. The fire shelter of claim 1, wherein the tongue completely and continuously circumscribes the shell perimeter and wherein the tongue provides a surface for the person to hold the fire shelter onto the ground.

8. The fire shelter of claim 1, wherein the tongue also comprises the at least one of a fire-resistant and fire-retardant material.

9. The fire shelter of claim 1, wherein the inflatable protection barrier comprises a shell and shell perimeter and wherein the inflatable internal volume traverses back and forth across the shell.

10. The fire shelter of claim 9, wherein the inflatable internal volume further traverses at least some of the shell perimeter.

11. The fire shelter of claim 9, wherein inflatable internal volume comprises a main inflatable cross member that bisects a plurality of inflatable cross members.

12. The fire shelter of claim 1, wherein the inflatable protection barrier is configured to be contained in a backpack.

13. The fire shelter of claim 1, wherein the inflatable internal volume consists of a single tubular structure.

14. The fire shelter of claim 13, wherein the single tubular structure is sewn to the sheet of material.

15. The fire shelter of claim 1, wherein the actuator is the only actuator used to inflate the inflatable internal volume.

16. A fire shelter kit, comprising:

a sheet of material comprising an inner surface and an outer surface, the sheet of material being constructed with at least one of a fire-resistant and fire-retardant material;

a single inflatable volume attached to the sheet of material; and an actuator in fluidic communication with the single inflatable volume, the actuator being configured to discharge at least one of a gas and fluid into the single inflatable internal volume thereby causing the single inflatable volume to deploy the sheet of material, wherein the sheet of material, when deployed, establishes a protected cavity adjacent to the inner surface that is open at its bottom thereby enabling a person to enter the protected cavity and further enabling cooling effects from ground to enter the protected cavity, and wherein the sheet of material further comprises a tongue that surrounds the open bottom and extends inwardly from an outer extent of the sheet of material toward the protected cavity and open bottom thereby enabling the person to hold the sheet of material onto the ground.

17. The fire shelter kit of claim 16, further comprising:

a storage pack configured to contain the sheet of material and single inflatable volume in an undeployed state.

18. The fire shelter kit of claim 16, wherein the tongue completely and continuously surrounds the open bottom, wherein the single inflatable volume is sewn to the sheet of material and wherein the at least one of a gas and fluid comprises a gas that is maintained in a compressed state in the actuator.

* * * * *